US005123701A

United States Patent [19]

Bottamiller et al.

[11] Patent Number: 5,123,701

[45] Date of Patent: Jun. 23, 1992

[54] GLIDE ROCKER

[76] Inventors: Wilbert O. Bottamiller, 16021 Pomerado Rd., Poway, Calif. 92064; George Spector, 233 Broadway Room 3815, New York, N.Y. 10007

[21] Appl. No.: 736,421

[22] Filed: Jul. 26, 1991

[51] Int. Cl.[5] ..... A47C 3/02

[52] U.S. Cl. ..... 297/261; 297/246; 5/108

[58] Field of Search ..... 297/261, 269, 273, 246, 297/280–282, 344, 329; 5/2, 101, 108, 109; 52/167 R

[56] References Cited

U.S. PATENT DOCUMENTS

| | | | |
|---|---|---|---|
| 91,469 | 6/1869 | McMurray | 297/261 |
| 247,847 | 10/1881 | Odell | 297/261 X |
| 465,719 | 12/1891 | Mitchell | 297/329 X |
| 699,567 | 5/1902 | Ralya | 297/246 |
| 742,932 | 11/1903 | Tuttle | 297/261 X |
| 2,500,316 | 3/1950 | Kramer | 297/344 X |
| 3,350,134 | 10/1967 | Kotler | 297/344 X |

FOREIGN PATENT DOCUMENTS

| | | | |
|---|---|---|---|
| 8603108 | 6/1986 | World Int. Prop. O. | 5/109 |

*Primary Examiner*—Peter R. Brown

[57] ABSTRACT

A glide rocker is provided and consists of a piece of furniture to accommodate at least one person thereon and a rocker base having a mechanism for moving the piece of furniture back and forth with respect to the floor.

3 Claims, 1 Drawing Sheet

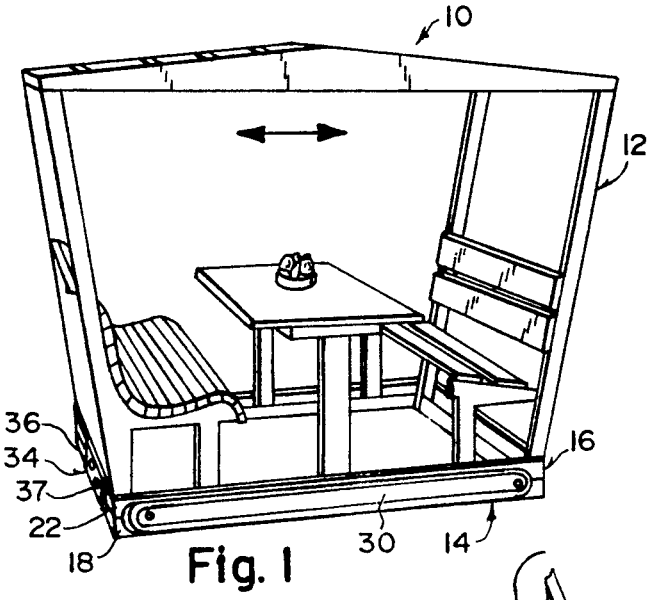
Fig. 1
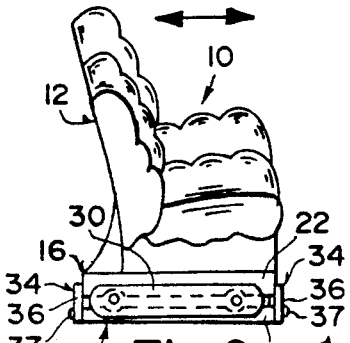
Fig. 6
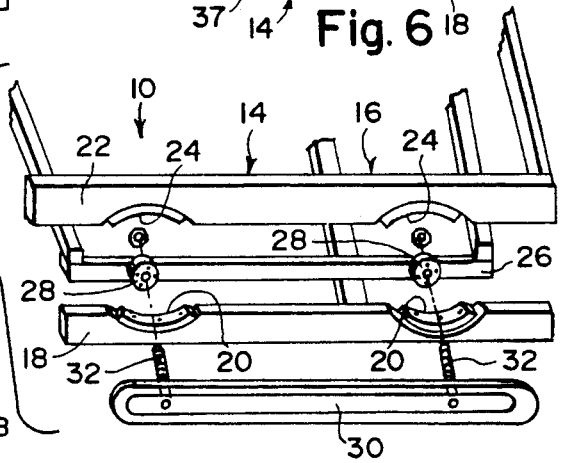
Fig. 2
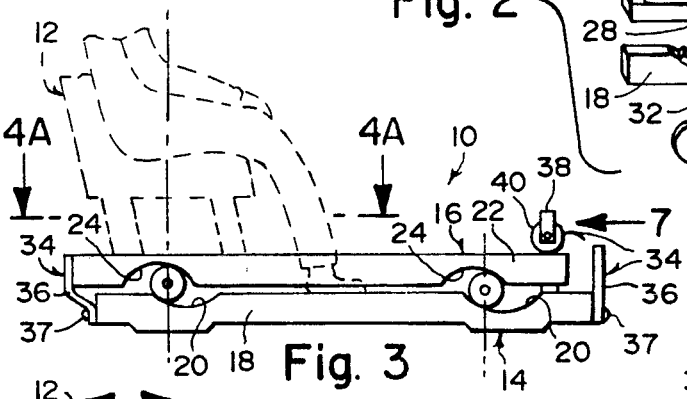
Fig. 3
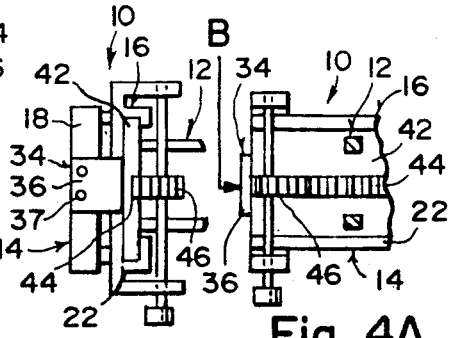
Fig. 4B
Fig. 4A
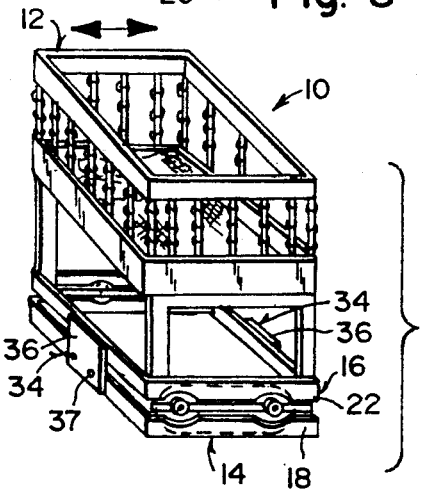
Fig. 5
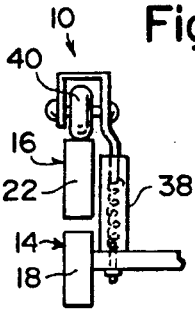
Fig. 7

GLIDE ROCKER

BACKGROUND OF THE INVENTION

The instant invention relates generally to rocking chairs and more specifically it relates to a glide rocker which provides a rocker base to allow its upper support frame to move back and forth.

There are available various conventional rocking chairs which do not provide the novel improvements of the invention herein disclosed.

SUMMARY OF THE INVENTION

A primary object of the present invention is to provide a glide rocker that will overcome the shortcomings of the prior art devices.

Another object is to provide a glide rocker that includes a rocker base which is of such construction that rollers carried on a guide frame between an upper support frame and a lower base frame will allow the upper support frame to move back and forth.

An additional object is to provide a glide rocker that includes a mechanism for preventing the upper support frame from becoming accidentally displaced from the guide frame and lower base frame.

A further object is to provide a glide rocker that is simple and easy to use.

A still further object is to provide a glide rocker that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of the instant invention being a glider swing.

FIG. 2 is an exploded perspective view of the rocker base.

FIG. 3 is a diagrammatic side view of the rocker base showing the upper support frame moved to one side.

FIG. 4A is a cross sectional view taken along line 4A—4A in FIG. 3, showing a modification to correct a fulcrum action in the rocker base which is an adjustable platform operable by a rack and pinion gear.

FIG. 4B is an end view taken in direction of arrow B in FIG. 4A.

FIG. 5 is a perspective view of a baby cradle rocker.

FIG. 6 is a perspective view of a love seat rocker.

FIG. 7 is an end view taken in direction of arrow 7 in FIG. 3, showing a retaining mechanism to prevent the fulcrum action in the rocker base.

DETAILED DESCRIPTION OF THE PREFERRED EMBODIMENTS

Turning now descriptively to the drawings, in which similar reference characters denote similar elements throughout the several views, the Figures illustrate a glide rocker 10 consisting of a piece of furniture 12, such as a glider swing, a baby cradle rocker or a love seat rocker to accommodate at least one person thereon and a rocker base 14 having a mechanism 16 for moving the piece of furniture 12 back and forth with respect to the floor.

The moving mechanism 16 in the rocker base 14 includes a lower base frame 18 which sits upon the floor in a stationary manner. The lower base frame 18 has two spaced apart upper curved tracks 20 in each side thereof. An upper support frame 22 is affixed to the bottom of the piece of furniture 12. The upper support frame 22 has two spaced apart lower curved tracks 24 in each side thereof. A guide frame 26 has two spaced apart rollers 28 on each side thereof which ride between the upper curved side tracks 20 in the lower base frame 18 and the lower curved side tracks 24 in the upper support frame 22 so that the guide frame 26 and the upper support frame 22 affixed to the piece of furniture 12, can move back and forth. A pair of elongated cover members 30 are also provided with each bolted at 32 and extending from the centers of the two spaced apart rollers 28 so as to cover one side of the lower base frame 18 and the upper support frame 22.

Each elongated cover member 30 keeps the upper support frame 22 centered on the upper curved side track 20 of the lower base frame 18 and prevents side drift as the guide frame 26 moves back and forth. It acts like a guide or channel. The guide frame 26 is not attached to either the base frame 18 or the upper support frame 22. Each roller 28 rides between the two halves, is kept in place by gravity downwardly, the elongated cover 30 inwardly and the guide frame 26 outwardly.

The glide rocker 10 further includes a mechanism 34 for preventing the upper support frame 22 from becoming accidentally displaced from the guide frame 26 and the lower base frame 18 when the upper support frame 22 is moved back and forth.

The prevention mechanism 34, as best seen in FIG. 3, includes a pair of retainer springs 36, each affixed at 37 to one opposite end of the lower base frame 18 so that their free ends will extend upwardly to the upper support frame 22. When the upper support frame 22 moves back and forth the retainer springs 36 will flex and keep the upper support frame 22 from becoming displaced. Optionally, the ends of the guide frame 26 can engage the lower base frame 18 to act as a mechanical stop and limit the travel of the roller 28 from ever reaching the top of the upper curved side track 20.

The prevention mechanism 34 further includes a downwardly forced spring biased wheel assembly 38 which is affixed to the lower base frame 18 so that a wheel 40 therefrom can ride on the top surface of the upper support frame 22 to prevent a fulcrum action on the upper support frame 22 when the center of gravity is moved past one of the rollers 28.

FIG. 4A and 4B show an adjustable platform 42 that is slideably carried on the upper support frame 22 whereby the platform 42 has the piece of furniture 12 affixed thereto. A rack member 44 is on the adjustable platform 42, while a pinion gear 46 is pivotally mounted to the upper support frame 22 and is engagable with the rack member 44, so when the pinion gear 46 is turned the platform 42 will slide to correct the center of gravity to reduce the fulcrum action on the upper support frame 22.

The invention as shown in FIGS. 1, 5 and 6 can be driven by a small motor to cause the rocking motion automatically and can be made adjustable for a desired motion. This would be especially desirable for rocking a baby to sleep gently as in FIG. 5 for the baby cradle rocker.

An alternate method of locking down the seat position using a sliding channel and a hand tight thumb screw may be used. The base of the baby cradle rocker can be built to rock end to end as well, such as that action of rocking a baby back and forth in a stroller.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A glide rocker which comprises:

a) a piece of furniture to accommodate at least one person thereon; and b) a rocker base having a means for moving said piece of furniture back and forth with respect to the floor; wherein said moving means in said rocker base includes:

c) a lower base frame which sits upon the floor in a stationary manner, said lower base frame having two spaced apart upper curved tracks in each side thereof;

d) an upper support frame which is affixed to the bottom of said piece of furniture, said upper support frame having two spaced apart lower curved tracks in each side thereof;

e) a guide frame having two spaced apart rollers on each side thereof which ride between the upper curved side tracks in said lower base frame and the lower curved side tracks in said upper support frame so that said guide frame and said upper support frame affixed to said piece of furniture can move back and forth;

f) a pair of elongated cover members, each bolted to and extending from the centers of said two spaced apart rollers so as to cover one side of said lower base frame and said upper support frame; further including means for preventing said upper support frame from becoming accidentally displaced from said guide frame and said lower base frame when said upper support frame is moved back and forth; wherein said prevention means includes a pair of retainer springs each affixed to one opposite end of said lower base frame so that said springs extend upwardly towards but do not connect to said upper support frame so that when said upper support frame moves back and forth said retainer springs will flex upon selective abutment of the upper support frame therewith and keep said upper support frame from becoming displaced.

2. A glide rocker as recited in claim 1, wherein said prevention means further includes a downwardly forced spring biased wheel assembly which is affixed to said lower base frame so that a wheel therefrom can ride on the top surface of said upper support frame to prevent a fulcrum action on said upper support frame when the center of gravity is moved past one of the rollers.

3. A glide rocker as recited in claim 2, further including:

a) an adjustable platform slideably carried on said upper support frame, said platform having said piece of furniture affixed thereto;

b) a rack member on said adjustable platform; and c) a pinion gear, pivotally mounted to said upper support frame and engagable with said rack member so that when said pinion gear is turned said platform will slide to correct the center of gravity to reduce the fulcrum action on said upper support frame.

* * * * *